US009946210B2

(12) United States Patent
Yamakawa et al.

(10) Patent No.: US 9,946,210 B2
(45) Date of Patent: Apr. 17, 2018

(54) SHEET TRANSPORT DEVICE AND IMAGE FORMING APPARATUS

(71) Applicant: FUJI XEROX CO., LTD., Tokyo (JP)

(72) Inventors: Yoichi Yamakawa, Kanagawa (JP); Shuhei Kobori, Kanagawa (JP); Shumpei Nozawa, Kanagawa (JP); Yasunobu Goto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/829,794

(22) Filed: Aug. 19, 2015

(65) Prior Publication Data

US 2016/0282782 A1 Sep. 29, 2016

(30) Foreign Application Priority Data

Mar. 27, 2015 (JP) ..... 2015-066875

(51) Int. Cl.

| | |
|---|---|
| ***G03G 15/00*** | (2006.01) |
| ***B65H 9/00*** | (2006.01) |
| ***B65H 5/06*** | (2006.01) |
| ***B65H 5/38*** | (2006.01) |
| ***B65H 7/02*** | (2006.01) |

(52) U.S. Cl.

CPC ..... *G03G 15/6529* (2013.01); *B65H 5/062* (2013.01); *B65H 5/38* (2013.01); *B65H 7/02* (2013.01); *B65H 9/004* (2013.01); *B65H 2404/611* (2013.01); *B65H 2701/1311* (2013.01); *B65H 2801/03* (2013.01); *G03G 2215/00679* (2013.01)

(58) Field of Classification Search

CPC ..... B65H 9/101; B65H 9/106; B65H 9/103; B65H 9/10; B65H 9/004; B65H 2701/1311

See application file for complete search history.

(56) References Cited

U.S. PATENT DOCUMENTS

| | | | | |
|---|---|---|---|---|
| 4,098,501 | A * | 7/1978 | Tani | B65H 3/06 221/198 |
| 8,348,266 | B2 * | 1/2013 | Deno | B65H 5/38 271/245 |
| 8,636,277 | B1 * | 1/2014 | Blair | B65H 1/266 271/109 |
| 8,789,827 | B2 | 7/2014 | Karikusa | |
| 2005/0062220 | A1 * | 3/2005 | Cardillo | B65H 9/06 271/236 |
| 2008/0054553 | A1 * | 3/2008 | Muneyasu | B65H 9/004 271/240 |

(Continued)

FOREIGN PATENT DOCUMENTS

JP 2014-005106 A 1/2014

*Primary Examiner* — Patrick Cicchino

(74) *Attorney, Agent, or Firm* — Sughrue Mion, PLLC

(57) ABSTRACT

A sheet transport device includes a sheet transport path along which a sheet is transported in one direction, plural abutting portions on which a leading end of the sheet transported along the sheet transport path abuts, the plural abutting portions being arranged in a direction intersecting the one direction, and a moving unit that moves the plural abutting portions and/or moves the sheet in the direction intersecting the one direction so that a preceding corner portion of two corner portions located at the leading end of the transported sheet abuts on any of the plural abutting portions.

8 Claims, 11 Drawing Sheets

(56) References Cited

U.S. PATENT DOCUMENTS

| | | | | |
|---|---|---|---|---|
| 2008/0232879 | A1* | 9/2008 | Shoji | B65H 5/34 399/395 |
| 2008/0310906 | A1* | 12/2008 | Yang | B41J 13/03 400/630 |
| 2009/0295079 | A1* | 12/2009 | Kinoshita | B65H 9/006 271/242 |
| 2013/0056926 | A1* | 3/2013 | Deno | B65H 7/08 271/228 |
| 2013/0214482 | A1* | 8/2013 | Matsumoto | B65H 7/10 271/228 |
| 2013/0241141 | A1* | 9/2013 | Karikusa | B65H 9/00 271/227 |
| 2013/0285316 | A1* | 10/2013 | Deno | B65H 7/00 271/229 |

* cited by examiner

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2015-066875 filed Mar. 27, 2015.

BACKGROUND

Technical Field

The present invention relates to a sheet transport device and an image forming apparatus.

SUMMARY

According to an aspect of the invention, there is provided a sheet transport device including a sheet transport path along which a sheet is transported in one direction, plural abutting portions on which a leading end of the sheet transported along the sheet transport path abuts, the plural abutting portions being arranged in a direction intersecting the one direction, and a moving unit that moves the plural abutting portions and/or moves the sheet in the direction intersecting the one direction so that a preceding corner portion of two corner portions located at the leading end of the transported sheet abuts on any of the plural abutting portions.

BRIEF DESCRIPTION OF THE DRAWINGS

An exemplary embodiment of the present invention will be described in detail based on the following figures, wherein:

FIGS. 7A to 7C1 and 7C2 illustrate a further exemplary structure;

DETAILED DESCRIPTION

An exemplary embodiment of the present invention will be described in detail below with reference to the attached drawings.

Figure 1:
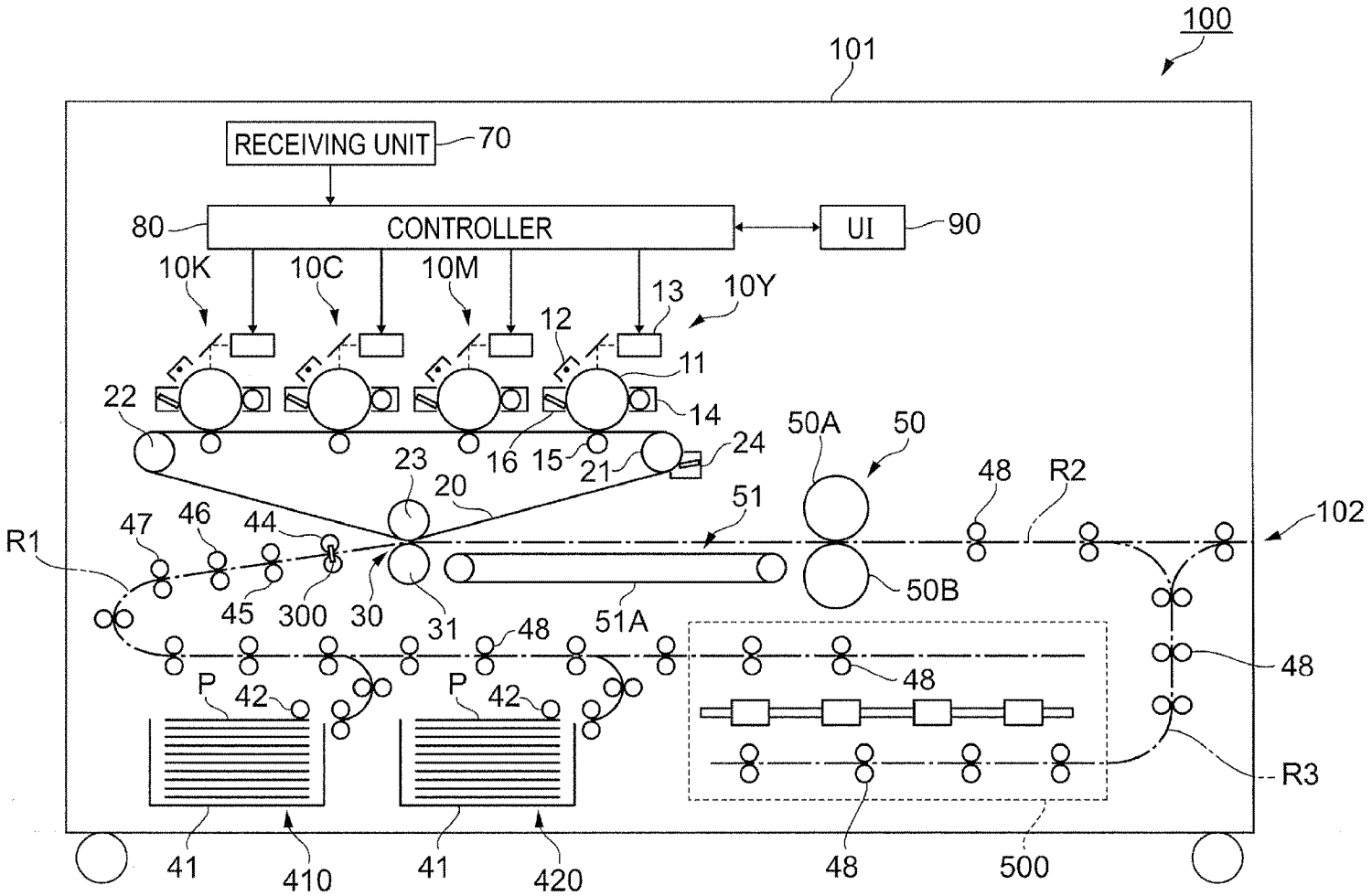
FIG. 1 is a front view of an image forming apparatus.

FIG. 1 is a front view of an image forming apparatus 100 according to the exemplary embodiment.

The image forming apparatus 100 includes plural image forming units 10 (10Y, 10M, 10C, and 10K) that form toner images of color components by an electrophotographic system.

The image forming apparatus 100 further includes a controller 80 that has a central processing unit (CPU), a read only memory (ROM), and so on. The controller 80 controls operations of devices and units included in the image forming apparatus 100.

The image forming apparatus 100 further includes a user interface unit (UI) 90 formed by a display panel. The user interface unit 90 outputs instructions received from the user to the controller 80, and displays information from the controller 80 to the user.

The image forming apparatus 100 further includes an intermediate transfer belt 20 on which color-component toner images formed by the image forming units 10 are to be sequentially transferred (first-transferred), and a second transfer device 30 that collectively transfers (second-transfers) the toner images on the intermediate transfer belt 20 onto a sheet P.

Here, the image forming units 10, the intermediate transfer belt 20, and the second transfer device 30 can be regarded as an image forming section that forms an image on a sheet P.

The image forming apparatus 100 further includes a first sheet transport path R1 through which a sheet P transported toward the second transfer device 30 passes, a second sheet transport path R2 through which the sheet P passes after passing through the second transfer device 30, and a third sheet transport path R3 that branches off from the second sheet transport path R2 and extends to a lower side of the first sheet transport path R1.

Further, an inverting mechanism 500 is provided to transport the sheet P from the third sheet transport path R3 to the first sheet transport path R1 and to invert the front and back sides of the sheet P. A housing 101 of the image forming apparatus 100 has an opening 102.

Sheets P transported along the second sheet transport path R2 are output to the outside of the housing 101 through the opening 102, and are stacked on an unillustrated sheet stack unit. A processing device (not illustrated) may be provided adjacently to the housing 101 to further subject the sheets P output from the opening 102 to processing such as punching.

Further, a first sheet supply device 410 and a second sheet supply device 420 are provided to supply sheets P to the first sheet transport path R1.

The first sheet supply device 410 and the second sheet supply device 420 have a similar structure, and each of the first sheet supply device 410 and the second sheet supply device 420 includes a sheet container 41 that contains sheets P and a take-out roller 42 that takes out and transports the sheets P contained in the sheet container 41.

On an upstream side of the second transfer device 30, a first transport roller (registration roller) 44 is provided to transport a sheet P on the first sheet transport path R1 toward the second transfer device 30. The first transport roller 44 is composed of a pair of roller members.

At a position of the first transport roller 44, a gate 300 on which a leading end (a side edge on the leading side) of a transported sheet P abuts is provided.

On an upstream side of the first transport roller 44, a second transport roller 45 is provided to send the sheet P toward the gate 300 so that the leading end of the sheet P abuts on the gate 300.

In the exemplary embodiment, the leading end of the sheet P abuts on the gate 300 to correct skew of the sheet P (tilt of the sheet P with respect to the sheet transport direction).

On an upstream side of the second transport roller 45, a third transport roller 46 is provided to transport the sheet P toward the second transport roller 45. On an upstream side of the third transport roller 46, a fourth transport roller 47 is provided to transport the sheet P toward the third transport roller 46.

In the exemplary embodiment, besides these transport rollers, plural transport rollers 48 are provided in the first sheet transport path R1, the second sheet transport path R2, and the third sheet transport path R3 to transport sheets P located on these transport paths.

A section where the first to fourth transport rollers 44 to 47 are provided has the function of transporting the sheet P. This section where the first to fourth transport rollers 44 to 47 are provided can be regarded as a sheet transport device.

On the second sheet transport path R2, a fixing device 50 is provided to fix an image second-transferred on the sheet P by the second transfer device 30 onto the sheet P.

Further, between the second transfer device 30 and the fixing device 50, a transport device 51 is provided to transport the sheet P passed through the second transfer device 30 to the fixing device 50. The transport device 51 includes a belt 51A that circularly moves, and transports the sheet P placed on the belt 51A.

The fixing device 50 includes a heating roller 50A to be heated by a built-in heater (not illustrated) and a pressure roller 50B that presses the heating roller 50A.

In the fixing device 50, the sheet P is pressurized and heated by passing between the heating roller 50A and the pressure roller 50B. Thus, the image is fixed on the sheet P.

In each of the image forming units 10, a rotatable photoconductor drum 11 is provided. Around the photoconductor drum 11, a charging device 12 for charging the photoconductor drum 11, an exposure device 13 for exposing the photoconductor drum 11 to write an electrostatic latent image, and a developing device 14 for developing the electrostatic latent image on the photoconductor drum 11 with toner into a visible image are provided.

Each image forming unit 10 further includes a first transfer device 15 that transfers the corresponding color component toner image formed on the photoconductor drum 11 onto the intermediate transfer belt 20, and a drum cleaning device 16 that removes residual toner on the photoconductor drum 11.

The intermediate transfer belt 20 serving as an example of an image bearing member bears toner images of the colors formed by the image forming units 10 functioning as an image forming mechanism.

The intermediate transfer belt 20 is rotatably stretched on three roll members 21 to 23. Of these three roll members 21 to 23, the roll member 22 drives the intermediate transfer belt 20. The roll member 23 is disposed opposed to a second transfer roller 31 with the intermediate transfer belt 20 being disposed therebetween. The second transfer roller 31 and the roll member 23 constitute the second transfer device 30. At a position opposed to the roll member 21 with the intermediate transfer belt 20 being disposed therebetween, a belt cleaning device 24 is provided to remove residual toner on the intermediate transfer belt 20.

In the image forming apparatus 100 of the exemplary embodiment, an image can be formed on one surface of a sheet P supplied from the first sheet supply device 410 or the like, and an image can also be formed on the other surface of the sheet P.

Specifically, in the image forming apparatus 100, the front and back surfaces of a sheet P passed through the fixing device 50 are inverted by the inverting mechanism 500, and the inverted sheet P is transported to the second transfer device 30 again. Then, an image is transferred on the other surface of the sheet P by the second transfer device 30. After that, the sheet P passes through the fixing device 50 again, and the transferred image is fixed on the sheet P. Thus, an image is formed not only on one surface of the sheet P but also on the other surface.

In the inverting mechanism 500, first, the sheet P on the third sheet transport path R3 moves in a direction orthogonal to the extending direction of the third sheet transport path R3, for example, toward the front of the image forming apparatus 100. This movement is made by an unillustrated dedicated transport roller.

At this time, the transport rollers 48 on the third sheet transport path R3 (the transport rollers 48 set inside the inverting mechanism 500) are in a separate state.

The sheet P moved in the above-described orthogonal direction moves upward, for example, along an unillustrated guide member having a substantially C-shaped cross section. A transport roller (not illustrated) is provided to transport the sheet P upward, and the sheet P is further moved upward by the transport roller.

After that, the sheet P moves from the side of the first sheet transport path R1 onto the first sheet transport path R1. At this time, the transport rollers 48 on the first sheet transport path R1 (the transport rollers 48 set inside the inverting mechanism 500) are in a separate state.

Next, the sheet P is nipped by the transport rollers 48, and the transport rollers 48 rotate. Thus, the inverted sheet P moves toward the second transfer device 30.

Figure 2:
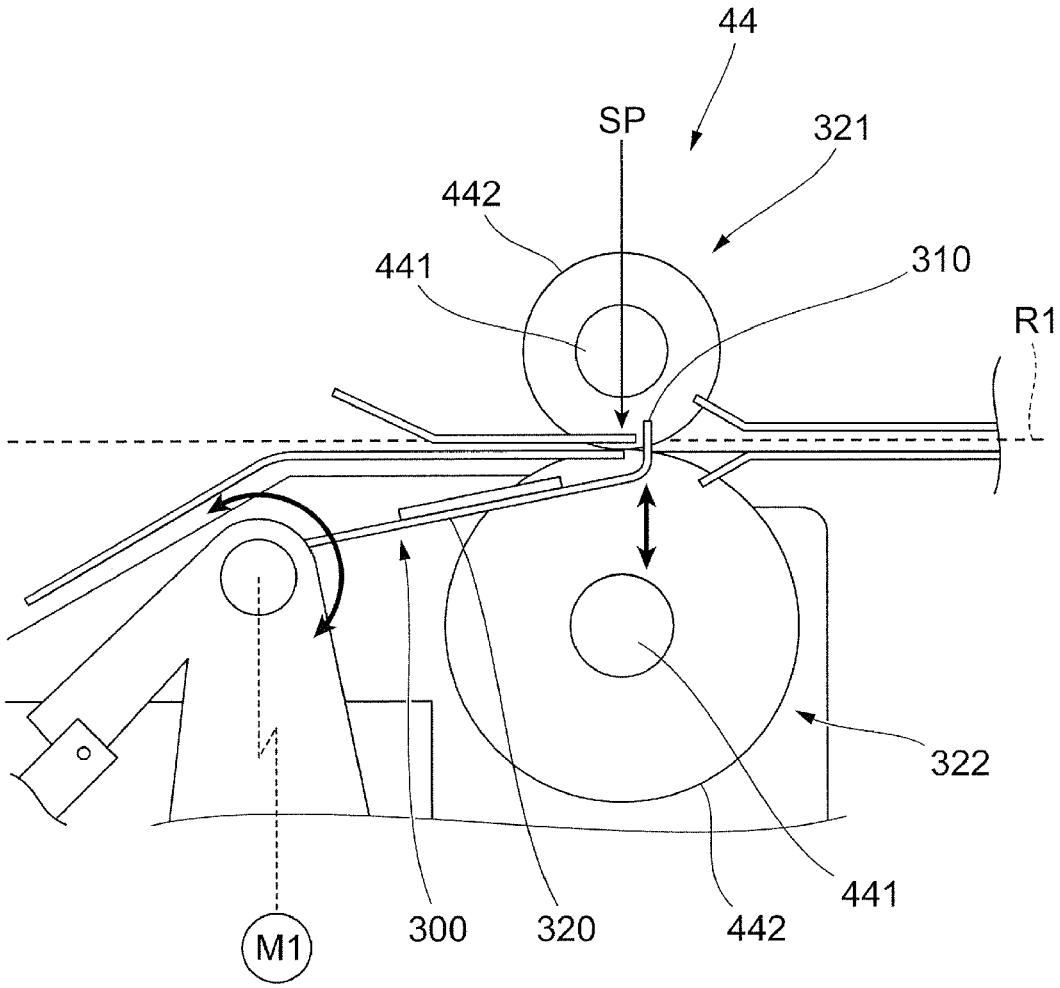
FIG. 2 is an enlarged view of a first transport roller and gates.

FIG. 2 is an enlarged view of the first transport roller 44 and the gate 300.

The gate 300 serving as an example of an abutting portion is formed by an L-shaped member, and includes a projecting piece 310 that projects from the first sheet transport path R1 and a support piece 320 that supports the projecting piece 310.

Further, in the exemplary embodiment, a motor M1 is provided to turn the gate 300. The motor M1 functions as a retracting unit. When the motor M1 is driven, the projecting piece 310 of the gate 300 retracts from the first sheet transport path R1.

The first transport roller 44 is composed of a pair of rotating members 321 and 322 disposed in contact with each other. In the exemplary embodiment, one of the rotating members 321 and 322 is rotated by the motor M1, and the other rotating member rotates along with rotation of the one rotating member.

Each of the rotating members 321 and 322 includes a rotation shaft 441 disposed in a direction intersecting (at right angles) the transport direction of the sheet P, and a columnar portion 442 attached to the rotation shaft 441. In the exemplary embodiment, the columnar portion 442 provided in the rotating member 321 and the columnar portion 442 provided in the rotating member 322 are in contact with each other. The columnar portions 442 are formed of, for example, rubber, and have elasticity.

Figure 3:
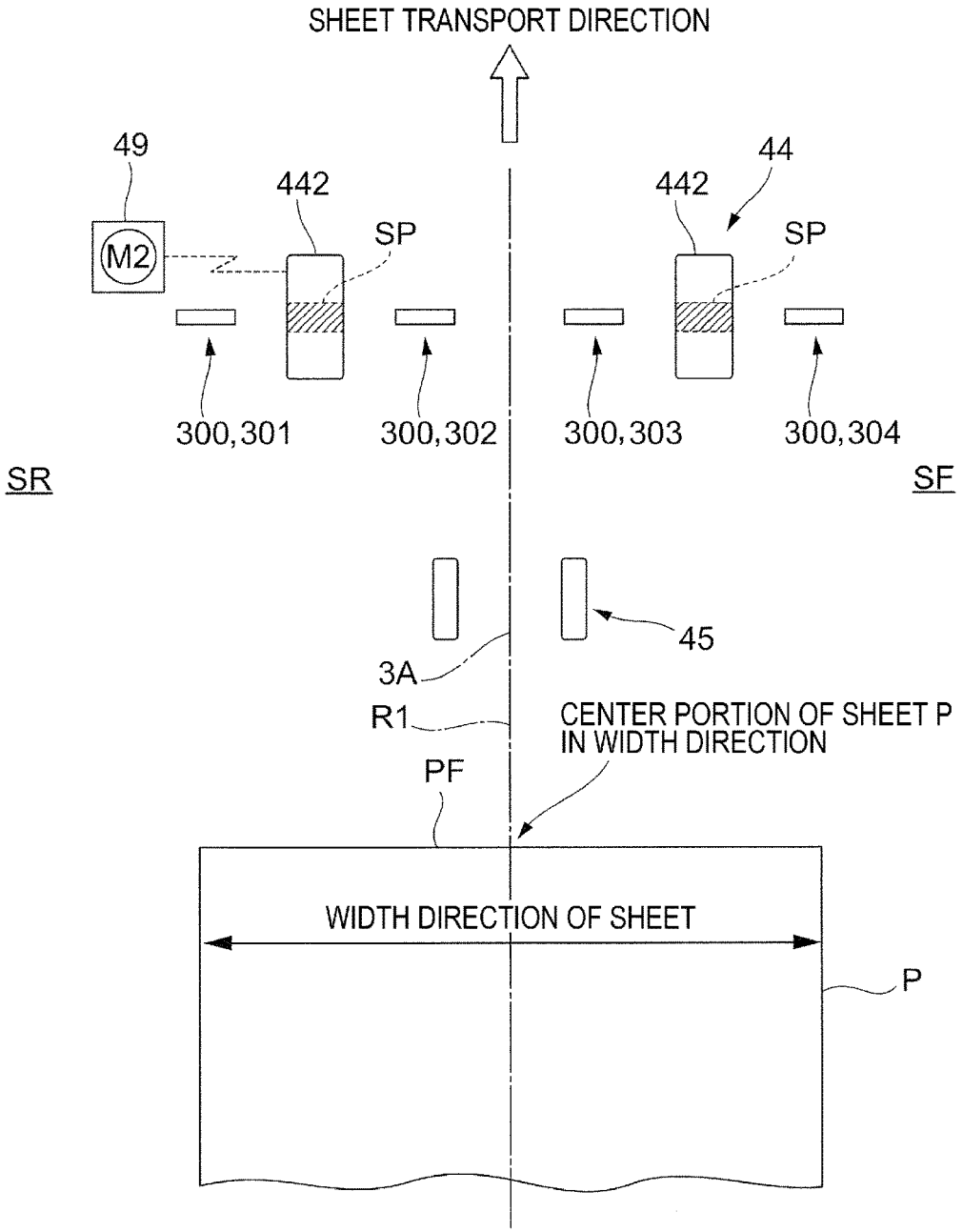
FIG. 3 is a top view of the first transport roller and the gates.

FIG. 3 is a top view of the first transport roller 44 and gates 300.

In the exemplary embodiment, plural (four in the exemplary embodiment) gates 300 are provided.

The plural gates 300 are arranged in a direction intersecting (at right angles) one direction in which the sheet P is transported (an upward direction in FIG. 3).

In the exemplary embodiment, a sheet P is transported in a so-called center reference manner. The plural gates 300 are distributed in the right-left direction with reference to the center of the transported sheet P. Specifically, in the exemplary embodiment, the sheet P is transported in a state in which a widthwise center portion of the sheet P is located on a reference 3A extending in the up-down direction of FIG. 3. The plural gates 300 are distributed on the right and left sides of the reference 3A.

In the exemplary embodiment, a common support member (not illustrated) is provided to support the plural gates 300 so that the gates 300 are combined together.

In this specification, the gate 300 located on the leftmost side of FIG. 3 is referred to as a first gate 301, the second gate 300 from the left is referred to as a second gate 302, the third gate 300 from the left is referred to as a third gate 303, and the fourth gate 300 from the left is referred to as a fourth gate 304.

As illustrated in FIG. 2, the first transport roller 44 includes the rotating members 321 and 322, and the rotating members 321 and 322 include their respective columnar members 442. Two columnar members 442 are provided in each of the rotating members 321 and 322. As illustrated in FIG. 3, the two columnar members 442 provided in each of the rotating members 321 and 322 are located at setting positions shifted from each other in the direction orthogonal to the extending direction of the first sheet transport path R1.

One columnar member 442 that is provided on one side SR of the first sheet transport path R1 is disposed between the first gate 301 and the second gate 302. The other columnar member 442 is disposed between the third gate 303 and the fourth gate 304.

The columnar members 442 function as a transport member. In the first transport roller 44, a sheet P is pushed out downstream and transported by the columnar members 442.

In the exemplary embodiment, a moving mechanism 49 is provided to move the first transport roller 44 in the direction orthogonal to the extending direction of the first sheet transport path R1 (in the width direction of the sheet P). The moving mechanism 49 includes a motor M2, a rack, a pinion, etc., and moves the first transport roller 44 by using these components.

Further, in the exemplary embodiment, a detection sensor (not illustrated) is provided to detect displacement of the sheet P in the width direction of the sheet P. In the exemplary embodiment, when the sheet P is displaced in the width direction, the first transport roller 44 is moved in the width direction of the sheet P by the moving mechanism 49. This suppresses the displacement of the image forming position on the sheet P from the original position.

Further, as described above, the first transport roller 44 of the exemplary embodiment is composed of a pair of rotating members 321 and 322. When the sheet P is transported by the first transport roller 44, it is nipped (held) by the pair of rotating members 321 and 322.

The movement in the width direction of the sheet P is made by moving the first transport roller 44 holding the sheet P in the axial direction. Here, the first transport roller 44 can be regarded as a sheet holding member that holds the sheet P.

In the exemplary embodiment, the gates 300 and the first transport roller 44 are combined with each other to move together.

For this reason, when the first transport roller 44 is moved in the direction orthogonal to the first sheet transport path R1 by the moving mechanism 49, the gates 300 are also moved in the orthogonal direction by the moving mechanism 49 functioning as a moving unit. Further, while the gates 300 are moved as will be described later in the exemplary embodiment, this movement is made by the moving mechanism 49.

Figure 4A:
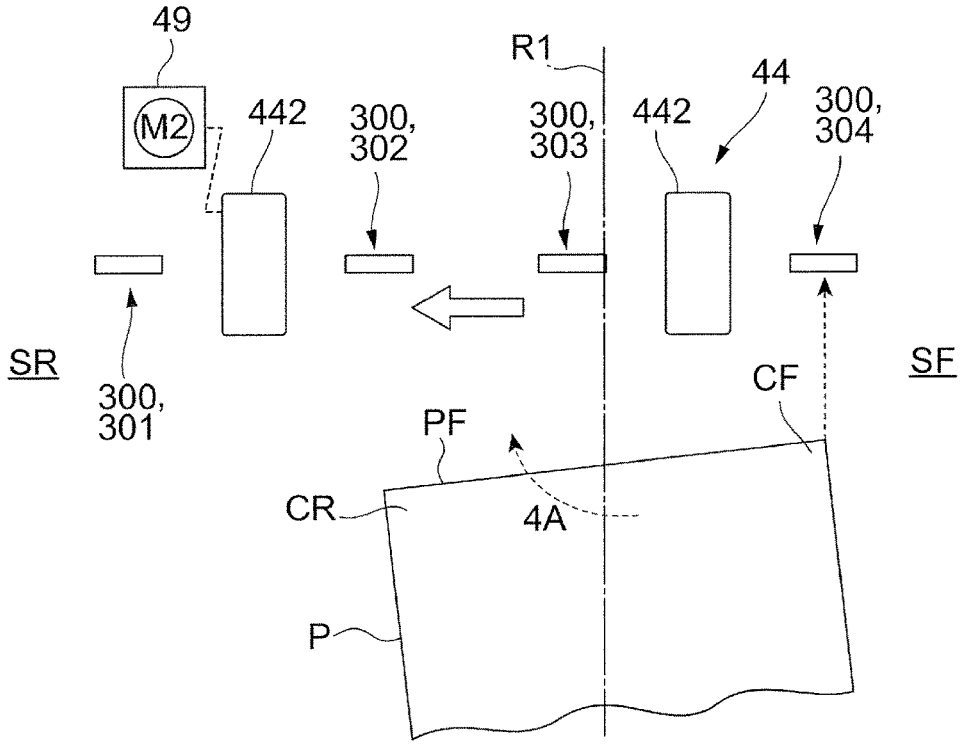
FIGS. 4A and 4B illustrate states of the gates and the first transport roller when a small-sized sheet is transported.
Figure 4B:
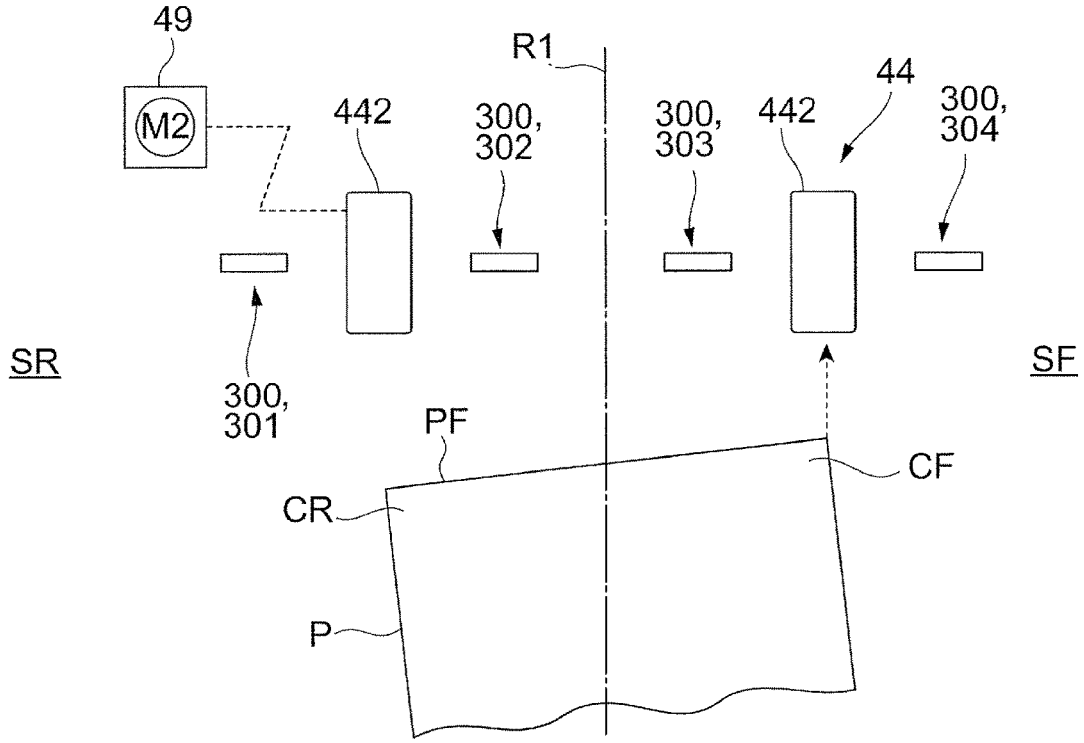

FIGS. 4A and 4B illustrate the states of the gates 300 and the first transport roller 44 when a small-sized sheet P is transported.

FIG. 4A illustrates the state of the gates 300 and the first transport roller 44 in the exemplary embodiment, and FIG. 4B illustrates the state of the gates 300 and the first transport roller 44 in a comparative example.

In the exemplary embodiment, as illustrated in FIG. 4A, when a small-sized sheet P is transported, the first gate 301 to the fourth gate 304 are moved to the left of FIG. 4A by a predetermined amount. Thus, the fourth gate 304 is positioned on a moving path of a preceding corner portion CF, of two corner portions CR and CF at the leading end of the sheet P.

Additionally, the sheet P is normally rectangular, and two corner portions CR and CF are located at the leading end of the sheet P in the transport direction of the sheet P. In the exemplary embodiment, the fourth gate 304 is located on the moving path of the preceding corner portion CF of the two corner portions CR and CF.

Thus, in the exemplary embodiment, the corner portion CF abuts on the fourth gate 304.

After that, a leading edge (a side edge located at the leading end) PF of the sheet P turns clockwise on the corner portion CF (see arrow 4A), and the leading edge PF entirely abuts on the gates 300. After that, in the exemplary embodiment, the gates 300 are retracted from the first sheet transport path R1. Thus, in the exemplary embodiment, the sheet P corrected for skew is transported downstream.

Next, the state of the gates 300 and the first transport roller 44 in the comparative example will be described with reference to FIG. 4B.

In this comparative example, the gates 300 are not moved to the left. For this reason, in the comparative example, the corner portion CF enters between the third gate 303 and the fourth gate 304.

In such a case, the leading edge PF of the sheet P is unlikely to be aligned with the gates 300, and the sheet P is unlikely to be corrected for skew.

In the image forming apparatus 100 of the exemplary embodiment, when the sheet P has a popular size such as an A4 size, the corner portions CR and CF of the sheet P abut on any of the gates 300. In contrast, when the sheet P has a small size like a sheet of a postcard size and an envelope, the corner portions CR and CF move between the adjacent gates 300.

For this reason, in the exemplary embodiment, when the sheet P has a small size, the gates 300 are moved to the left, as described above, to be located at the destinations of the corner portions CR and CF.

The movement of the gates 300 is not made only when the size of the sheet P is small, and may be made in other cases. Specifically, for example, when the sheet P has an irregular size, the corner portions CR and CF may enter between the gates 300 although the size of the sheet P is large.

In such a case, the gates 300 can also be moved to be located at the destinations of the corner portions CR and CF.

The image forming apparatus 100 sometimes has its peculiar habits. In the image forming apparatus 100 of the exemplary embodiment, when the sheet P is transported, the corner portion CF on the right side of FIG. 4A precedes. Additionally, the corner portion CF located on the other side SF of the first sheet transport path R1 precedes. Accordingly, in the exemplary embodiment, the gates 300 are moved to the one side SR. This allows any of the gates 300 to be located at the destination of the corner portion CF.

When the opposite corner portion CR precedes in the image forming apparatus 100, the gates 300 are moved to the other side SF of the first sheet transport path R1.

Figure 5:
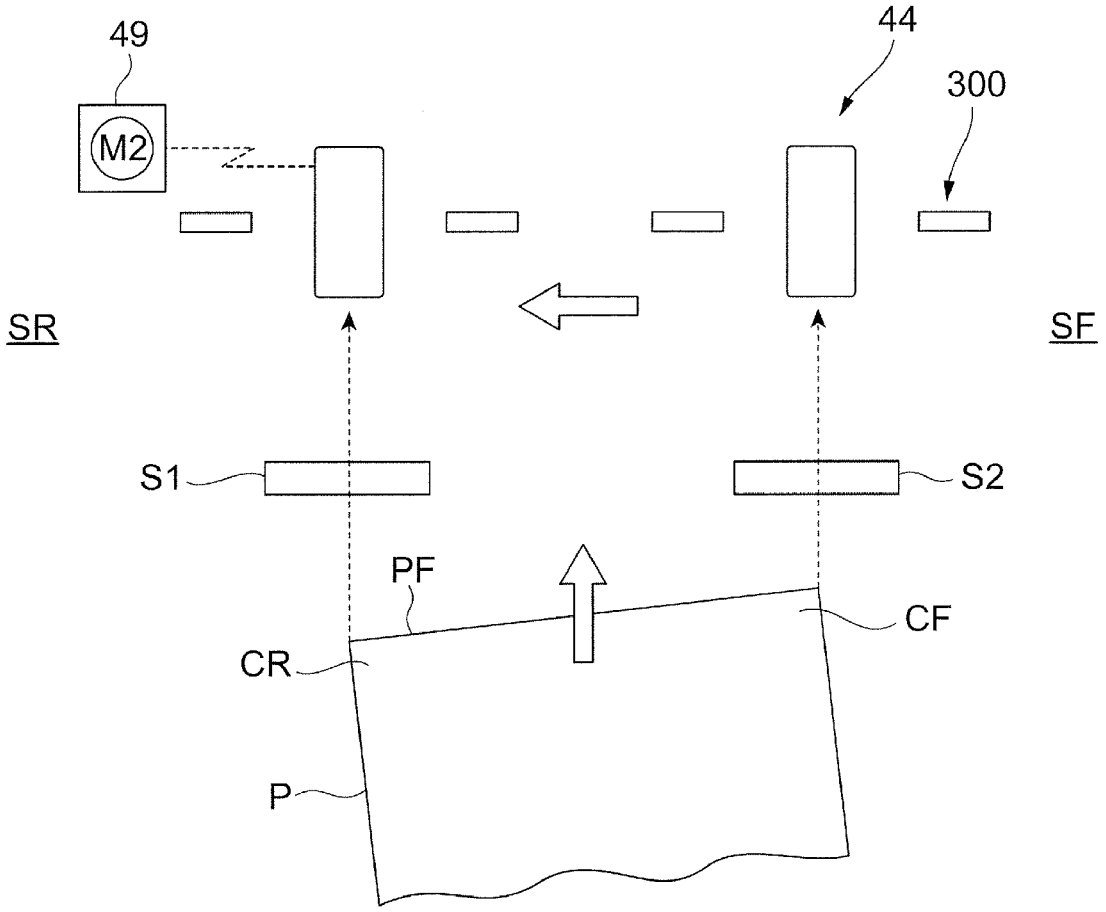
FIG. 5 illustrates another exemplary structure including detection sensors for detecting a leading end of a sheet.

FIG. 5 illustrates another exemplary structure including detection sensors that detect the leading end of a sheet P.

In the exemplary structure illustrated in FIG. 5, two sensors, namely, a first sensor S1 and a second sensor S2 are provided.

The first sensor S1 is provided on one side SR, and detects one corner portion CR of the sheet P. The second sensor S2 is provided on the other side SF, and detects the other corner portion CF of the sheet P.

In this exemplary structure, two sensors, that is, the first sensor S1 and the second sensor S2 serving as a detector are used to detect which of the two corner portions CR and CF at the leading end of the sheet P precedes. Then, on the basis of the detection result, the gates 300 are moved to abut on the preceding corner portion.

In the image forming apparatus 100, only one corner portion does not always precedes, and the preceding corner portion may differ every time a sheet P is transported.

By providing the first sensor S1 and the second sensor S2 as in the exemplary structure, the possibility that the preceding corner portion abuts on the gates 300 is increased.

When the gates 300 are moved, as described above, the image forming position on the intermediate transfer belt 20 functioning as the image bearing member is preferably shifted from the original forming position (predetermined forming position).

Specifically, for example, when the gates 300 are moved to the one side SR, the image forming position on the intermediate transfer belt 20 is preferably shifted to the other side SF. In other words, when the gates 300 are moved to one side, the image forming position on the intermediate transfer belt 20 is preferably shifted to the side opposite from the one side.

Figure 6A:
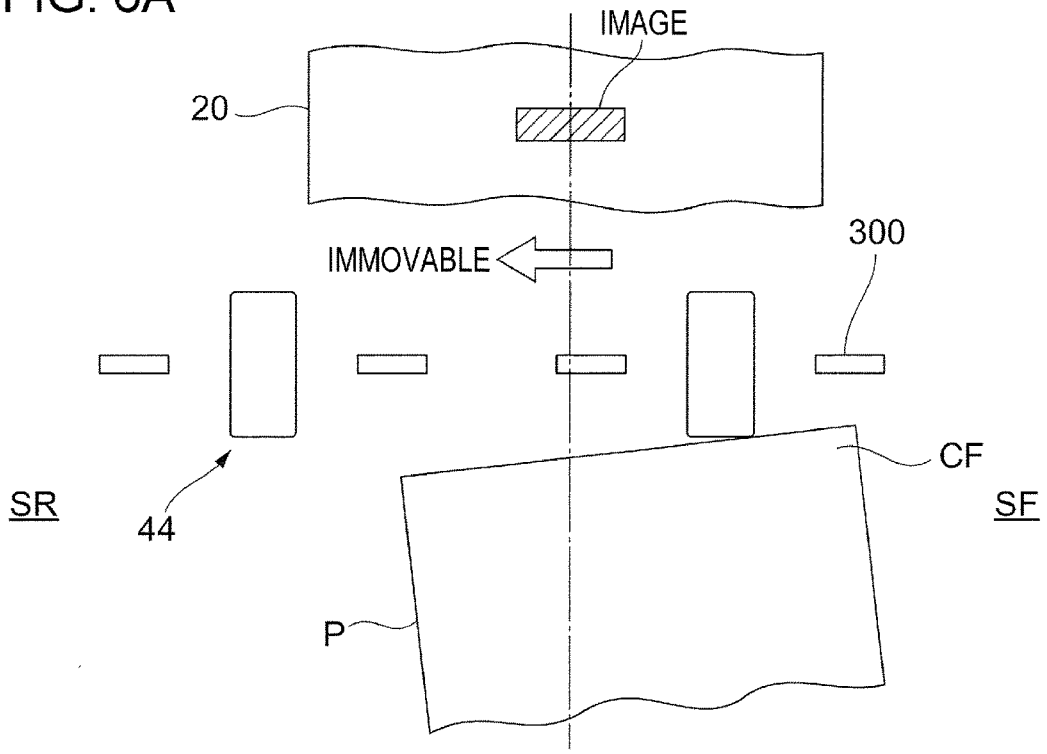
FIGS. 6A and 6B illustrate the image forming position on an intermediate transfer belt.
Figure 6B:
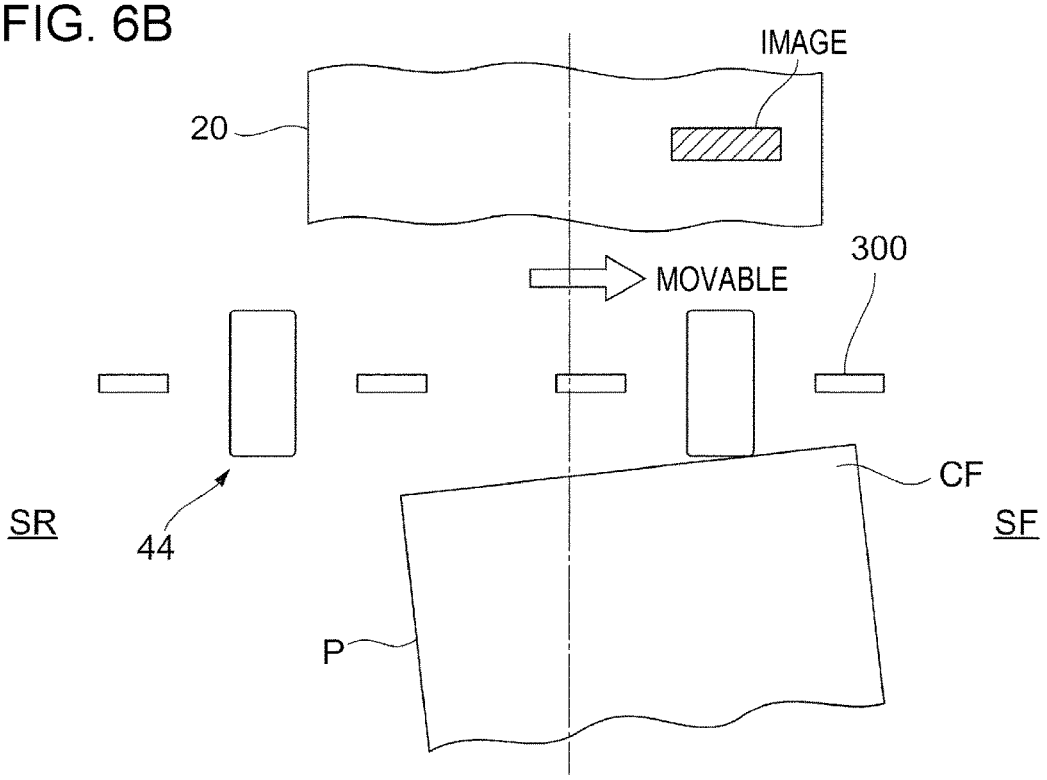

FIGS. 6A and 6B illustrate the image forming position on the intermediate transfer belt 20.

Here, FIG. 6A illustrates the operation in a comparative example, and FIG. 6B illustrates the operation in the exemplary embodiment. Further, FIGS. 6A and 6B illustrate a case in which the gates 300 are moved to one side SR.

In the operation of the comparative example of FIG. 6A, the forming position of an image (a toner image) on the intermediate transfer belt 20 is not changed, and for example, an image is formed in a center portion of the intermediate transfer belt 20 in the width direction. Further, the gates 300 are moved to one side SR so that a corner portion CF of a sheet P abuts on the gates 300. When the gates 300 are moved to the one side SR, a first transport roller 44 is also moved to the one side SR.

The sheet P not only tilts, but also is sometimes transported while being shifted in the width direction. Specifically, as illustrated in FIG. 6A, the sheet P is sometimes transported while being shifted to the other side SF.

In such a case, the first transport roller 44 needs to be moved to the one side SR (the sheet P needs to be moved to the one side SR). However, the first transport roller 44 has already been moved to the one side SR. In this case, it is difficult to move the first transport roller 44 to the one side SR. Further, in this case, an image is formed at a position on the sheet P shifted from the original image forming position.

In contrast, in the exemplary embodiment, as illustrated in FIG. 6B, the image forming position on the intermediate transfer belt 20 is shifted to the other side SF. Additionally, the image forming position is shifted to the other side SF from the center portion of the intermediate transfer belt 20 serving as the predetermined image forming position.

In this case, the first transport roller 44 needs to be moved to the other side SF. However, the moving amount of the first transport roller 44 can be ensured. Then, an image is formed at the original image forming position on the sheet P.

The image forming position on the intermediate transfer belt 20 is shifted by shifting the image forming position on the photoconductor drum 11 in the axial direction of the photoconductor drum 11.

FIGS. 7A to 7C1 and 7C2 illustrate a further exemplary structure.

While the corner portions CR and CF are abutted on the gates 300 by moving the gates 300 in the above, they may be abutted by moving a sheet P.

Figure 7A:
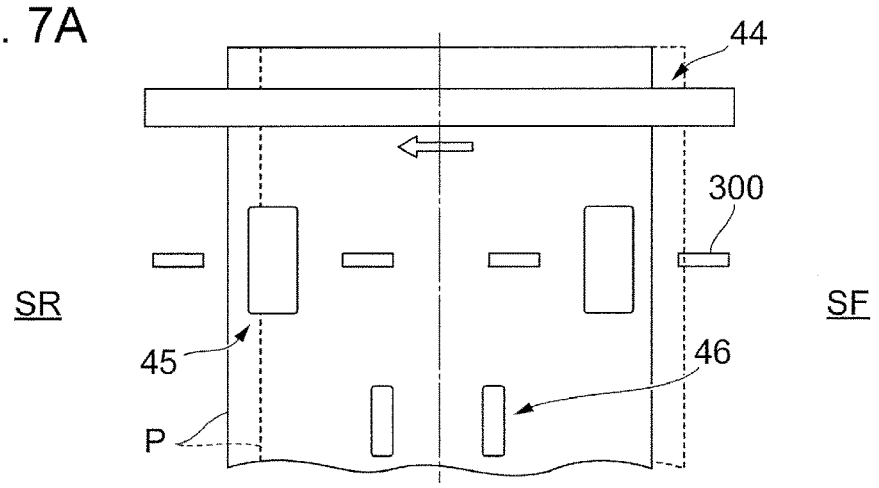
Figure 7B:
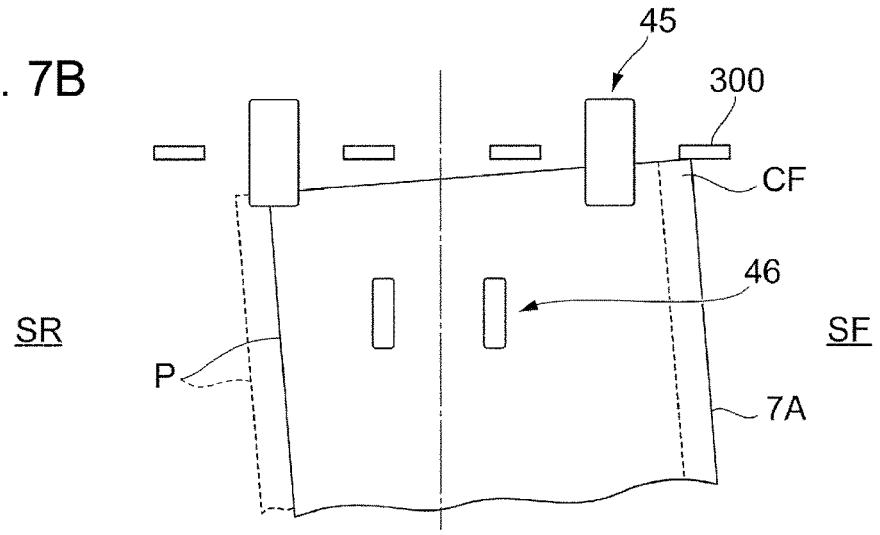
Figure 7B:
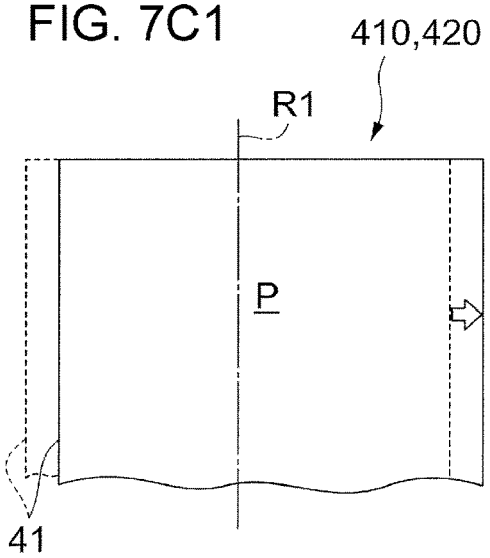
Figure 7B:
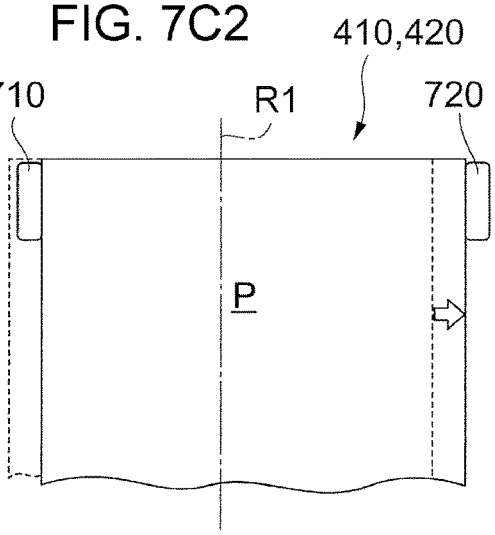

Specifically, in the exemplary structure illustrated in FIGS. 7A to 7C1 and 7C2, as illustrated in FIG. 7C1, a sheet P is moved by moving the sheet container 41 provided in the first sheet supply device 410 or the second sheet supply device 420 (also see FIG. 1) in the direction orthogonal to (intersecting) the extending direction of the first sheet transport path R1. Thus, as shown by sign 7A in FIG. 7B, a corner portion CF of the sheet P abuts on a gate 300.

In this exemplary structure, as illustrated in FIG. 7A, gates 300 are provided not in the first transport roller 44, but in the second transport roller 45.

Since the sheet P is moved in the exemplary structure, the position of the sheet P shifts to the other side SF from the original position.

For this reason, in this exemplary structure, as illustrated in FIG. 7A, when the sheet P reaches the first transport roller 44, the first transport roller 44 is moved to the one side of the SR. The sheet P is thereby returned to the original position.

FIG. 7C2 illustrates an exemplary structure in which the position of a sheet P is shifted by using sheet guides 710 and 720.

In the exemplary structure of FIG. 7C1, the position of the sheet P is shifted by moving the sheet container 41 by the driving source such as a motor. In the exemplary structure of FIG. 7C2, the position of the sheet P is shifted using the sheet guides 710 and 720 to be operated by the user.

Figure 8:
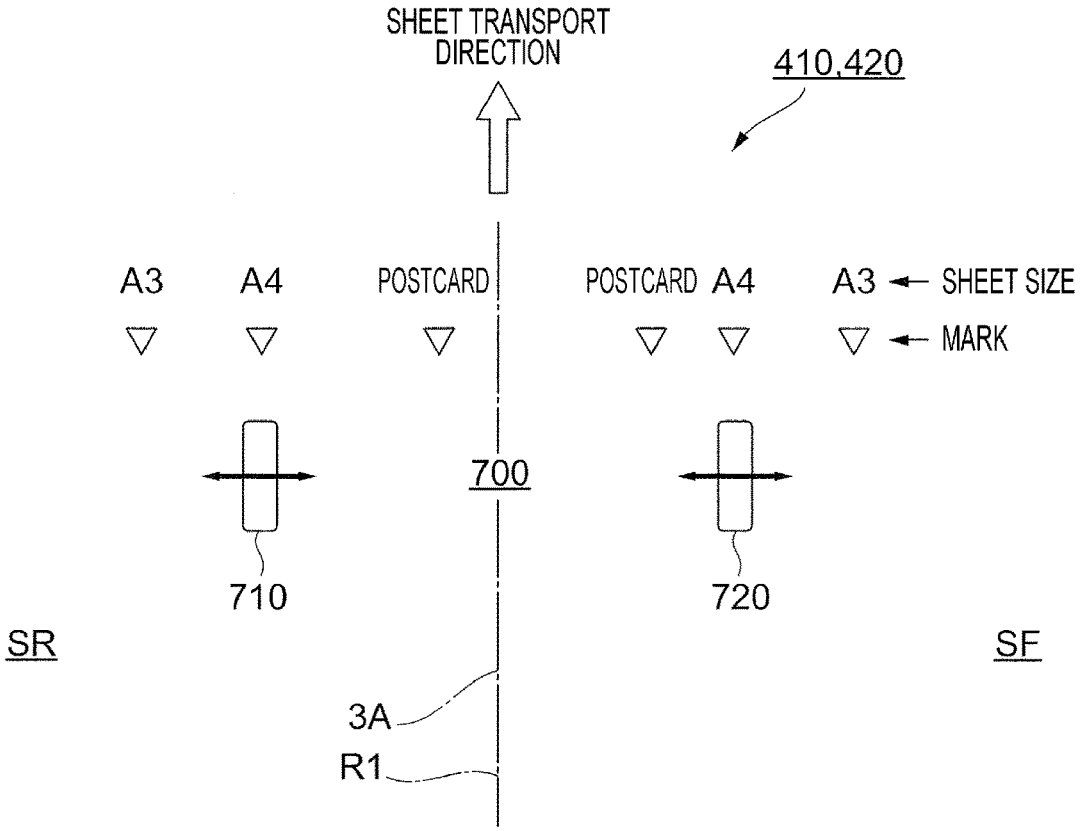
FIG. 8 is a top view of a first sheet supply device and a second sheet supply device.

FIG. 8 is a top view of the first sheet supply device 410 or the second sheet supply device 420.

The sheet guides 710 and 720 are provided in each of the first sheet supply device 410 and the second sheet supply device 420. The first sheet supply device 410 and the second sheet supply device 420 are each provided with a support surface 700 that supports sheets from below.

The sheet guides 710 and 720 are set to project upward from the support surface 700. Further, the sheet guides 710 and 720 can slide in the right-left direction (a direction orthogonal to the extending direction of the first sheet transport path R1) in FIG. 8.

Sheets P are stored between the sheet guide 710 and the sheet guide 720. The sheet guide 710 is pressed against one side of the sheets P, and the sheet guide 720 is pressed against the other side of the sheets P. Further, since the sheet guides 710 and 720 are slidable in this exemplary structure, sheets P of various sizes can be stored between the sheet guide 710 and the sheet guide 720.

Further, the support surface 700 has inscribed "marks" and "sheet sizes" to be referred to by the user when the user determines the positions of the sheet guide 710 and the sheet guide 720.

In this exemplary structure, sheet sizes, such as "A3", "A4", and "POSTCARD", are inscribed, and marks corresponding to the sheet sizes are provided.

In the exemplary embodiment, the sheets P are transported in a so-called center reference manner, as described above. Hence, the sheets P are also stored in the first sheet supply device 410 and the second sheet supply device 420 in the center reference manner. Specifically, the sheets P are stored so that center portions of the sheets P in the width direction are located on a reference 3A.

To make such storage possible, in the exemplary embodiment, two marks corresponding to "A3" are disposed at an equal distance from the reference 3A, and two marks corresponding to "A4" are also disposed at an equal distance from the reference 3A. Additionally, the two marks corresponding to "A3" and the two marks corresponding to "A4" are disposed on the right and left sides of the reference 3A.

In contrast, two marks corresponding to "POSTCARD" are shifted to the other side SF. Thus, the storage position in the width direction of sheets P of the "POSTCARD" size is shifted, and the sheets P are stored while being shifted from the reference 3A to the other side SR.

This allows the corner portions of the sheets P to abut on the gates 300, similarly to the case in which the sheet container 41 is moved.

While the corner portions are abutted on the gates 300 by moving one of the gates 300 and the sheets P in the above, both the gates 300 and the sheets P may be moved without moving only one of them.

Figure 9:
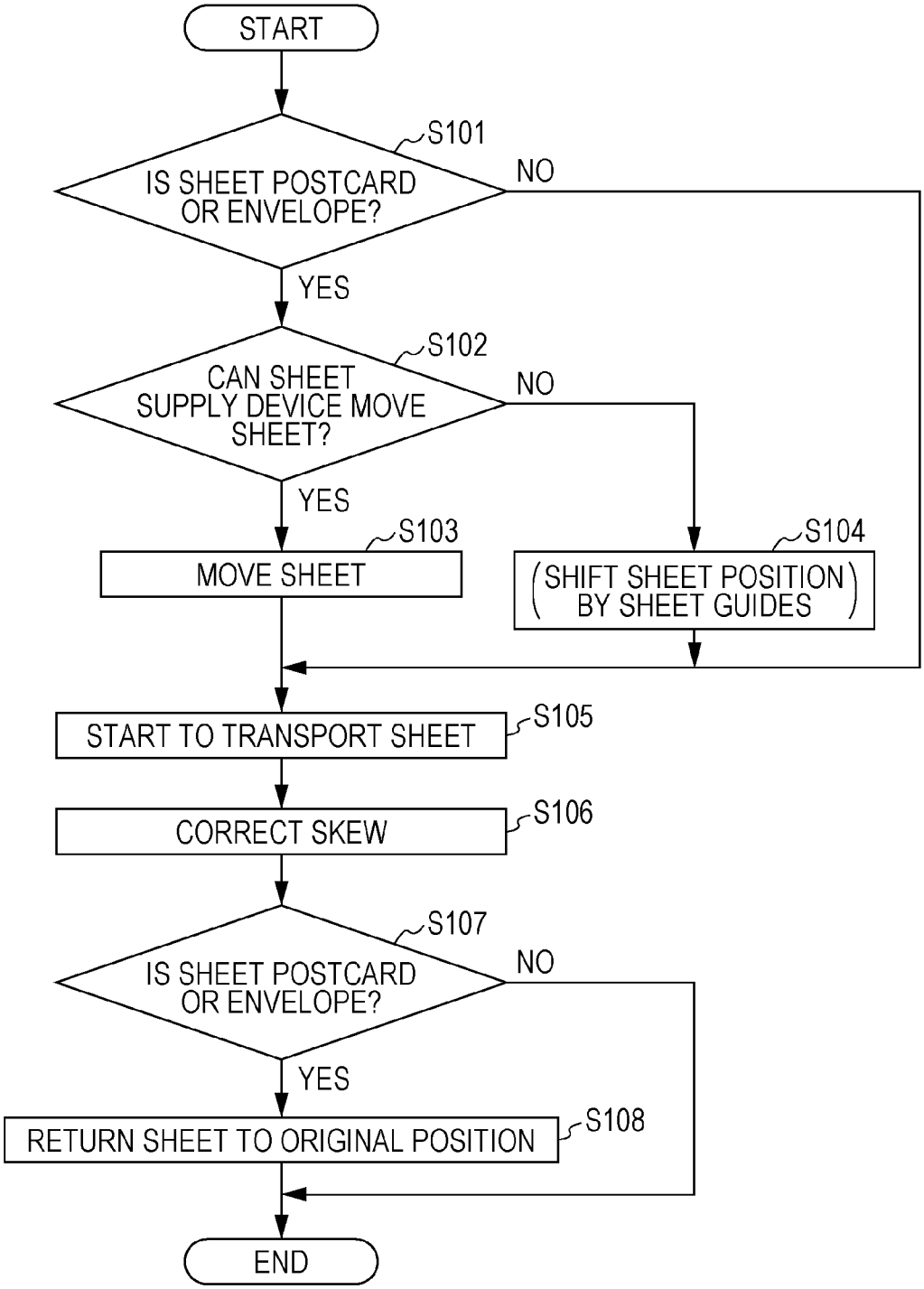
FIG. 9 is a flowchart showing the flow of a series of steps in a procedure for moving a sheet so that corner portions of the sheet abut on the gates.

FIG. 9 is a flowchart showing the flow of a series of steps in a procedure for moving a sheet P so that the corner portion of the sheet P abuts on the gate 300. These steps are executed by the controller 80.

In the exemplary embodiment, it is first determined whether a sheet P to be transported (subjected to image formation) is a sheet of a postcard size (hereinafter, simply referred to as "postcard") or an envelope (Step S101).

When the sheet P is neither a postcard nor an envelope, the procedure proceeds to Step S105.

When the sheet P is a postcard or an envelope, it is determined whether or not the first sheet supply device 410 or the second sheet supply device 420 can move the sheet P (can move the sheet container 41) (Step S102). When the first sheet supply device 410 or the second sheet supply device 420 can move the sheet P, the sheet P is moved (Step S103).

When the first sheet supply device 410 or the second sheet supply device 420 cannot move the sheet P, the position of the sheet P is shifted by the sheet guides 710 and 720 disposed at shifted positions (Step S104).

After that, transportation of the sheet P is started (Step S105). Then, the sheet P is abutted on the gates 300 to correct skew (Step S106).

Next, it is determined whether or not the sheet P is a postcard or an envelope (Step S107). When the sheet P is a postcard or an envelope, the first transport roller 44 is moved to return the sheet P to the original position, as illustrated in FIG. 7A (Step S108).

Figure 10A:
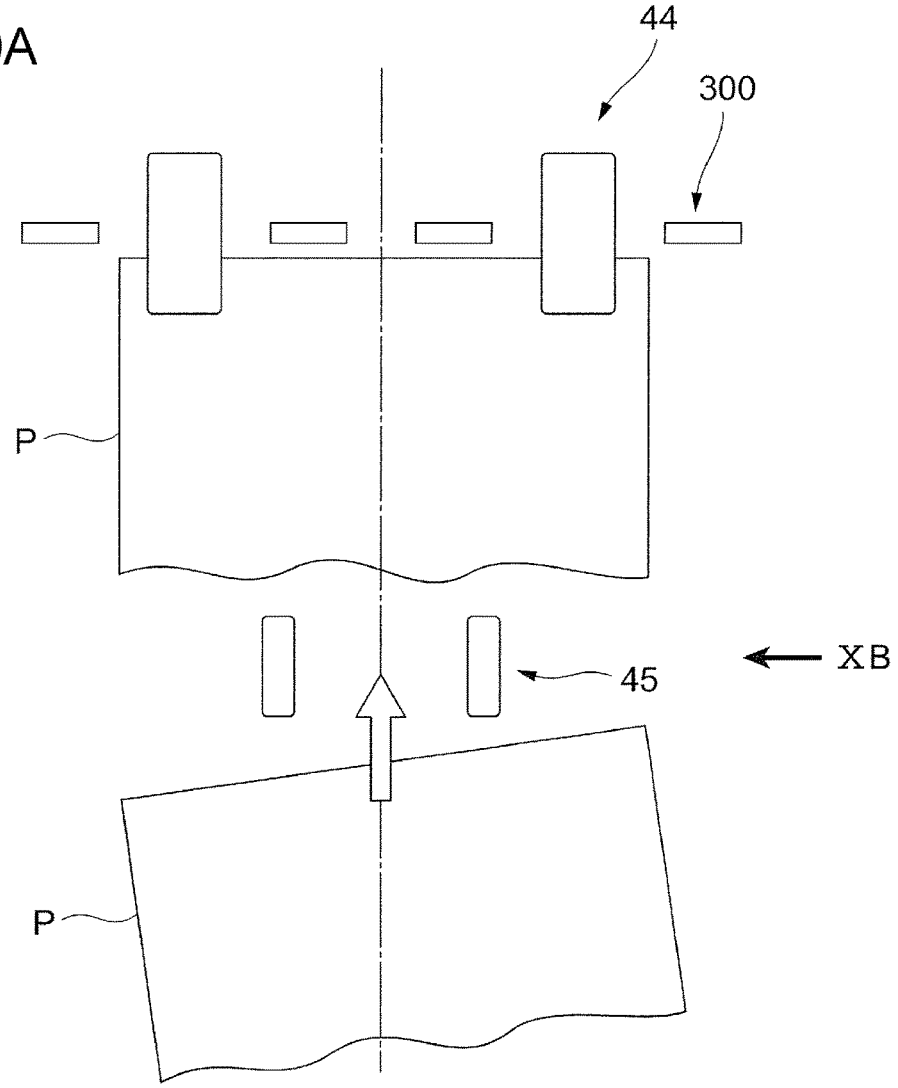
FIGS. 10A and 10B illustrate a further exemplary structure.
Figure 10B:
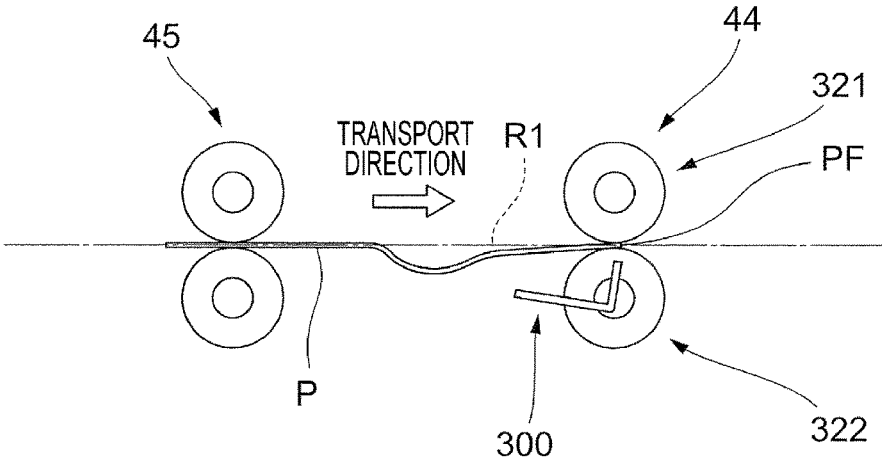

FIGS. 10A and 10B illustrate a further exemplary structure. FIG. 10A is a top view of a first transport roller 44 and so on, and FIG. 10B is a side view of the first transport roller 44 and so on, when viewed from a direction of arrow XB of FIG. 10A.

While the sheet P and the gates 300 are moved in the width direction of the sheet P in the above-described exemplary structures, the sheet P can be corrected for skew without making such movement.

In the exemplary structure illustrated in FIGS. 10A and 10B, when a sheet P, such as a postcard, is transported, the gates 300 are retracted from a first sheet transport path R1, as illustrated in FIG. 10B. Then, a leading edge PF of the sheet P is abutted on the first transport roller 44.

More specifically, in the exemplary embodiment, the leading edge PF of the sheet P is abutted on a contact portion SP (see FIG. 2) (a nip) where two columnar members 442 are in contact with each other.

Further, in the exemplary embodiment, as illustrated in FIG. 3, two pairs of columnar members 442 are provided, and two contact portions SP are provided. In the exemplary embodiment, the leading edge PF of the sheet P is abutted on the two contact portions SP. Additionally, the leading edge PF of the sheet P is abutted on the two contact portions SP that are shifted from each other in the width direction of the sheet P. This corrects skew of the sheet P.

When the sheet P is abutted on the first transport roller 44, the rotation of the first transport roller 44 is stopped. In the exemplary embodiment, after the sheet P is abutted on the first transport roller 44 and is corrected for skew, the first transport roller 44 is rotated. The sheet P corrected for skew is thereby transported downstream.

Figure 11:
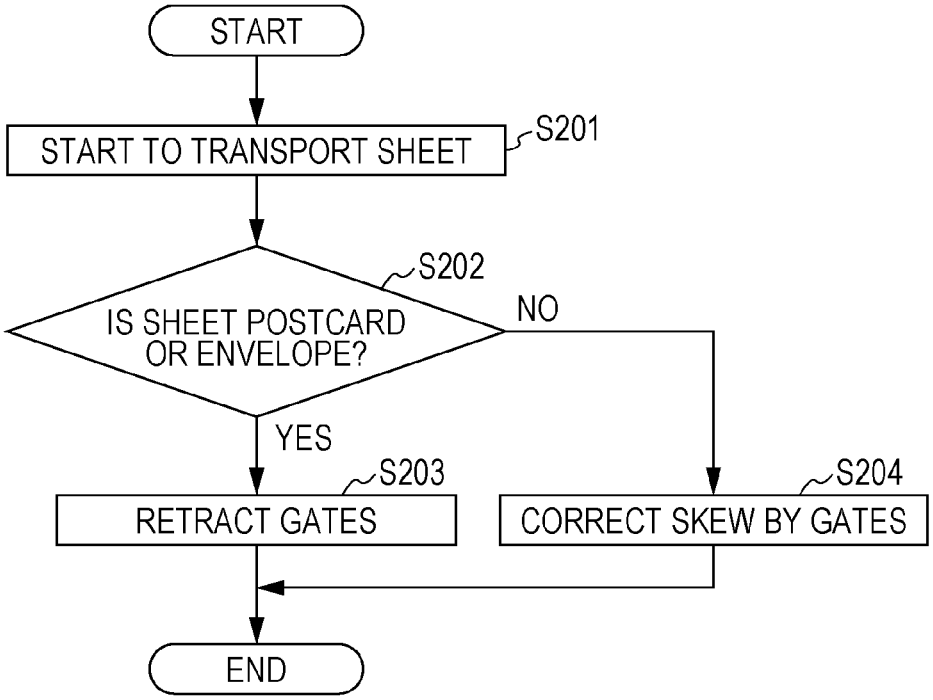
FIG. 11 is a flowchart showing the flow of a series of steps in a procedure for retracting the gates.

FIG. 11 is a flowchart showing the flow of a series of steps in a procedure for retracting the gates 300.

In this procedure, first, transportation of a sheet P is started (Step S201), and it is then determined whether or not the sheet P is a postcard or an envelope (Step S202).

When the sheet P is a postcard or an envelope, the gates 300 are retracted (Step S203). Thus, the leading end of the sheet P is abutted on the first transport roller 44.

In contrast, when the sheet P is neither a postcard nor an envelope, skew is corrected by the gates 300 (Step S204).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

a sheet transport path along which a sheet is transported in first direction;

a plurality of abutting portions on which a leading end of the sheet transported along the sheet transport path abuts, the plurality of abutting portions being arranged in a second direction intersecting the first direction, the second direction being a widthwise direction of the sheet;

a moving unit configured to move the plurality of abutting portions or to move the sheet in the second direction intersecting the first direction; and a controller configured to control the moving unit to move the plurality of abutting portions or to move the sheet in the second direction intersecting the first direction so that a preceding corner portion of two corner portions located at the leading end of the transported sheet abuts on any of the plurality of abutting portions; and a detector configure to detect which of the two corner portions located at the leading end of the sheet is the preceding corner portion, wherein the preceding corner portion is defined as a point where two peripheral edges of the sheet intersect.

2. The sheet transport device according to claim 1, further comprising:

a sheet container in which the sheet to be supplied to the sheet transport path is stored, wherein the moving unit is configured to move the sheet in the direction intersecting the first direction by moving the sheet container in the direction intersecting the first direction.

3. The sheet transport device according to claim 1, further comprising:

an image bearing member located on a downstream side of the plurality of abutting portions in a transport direction of the sheet to bear an image to be formed on the sheet;

an image forming mechanism configured to form the image on the image bearing member; and a sheet holding member configure to move together with the plurality of abutting portions and moves in the direction intersecting the first direction while holding the sheet whose leading end abuts on the plurality of abutting portions, wherein the moving unit is configured to move the plurality of abutting portions in the direction intersecting the first direction and moves the plurality of abutting portions toward one side of the one side and the other side of the sheet transport path, and wherein the image forming mechanism is configured to form the image at a predetermined position on the image bearing member and shifts a forming position of the image toward the other side from the predetermined position when the plurality of abutting portions are moved toward the one side by the moving unit.

4. A sheet transport device comprising:

a sheet transport path along which a sheet is transported in a first direction;

a plurality of abutting portions on which a leading end of the sheet transported along the sheet transport path abuts, the plurality of abutting portions being arranged in a second direction corresponding to a widthwise direction of the sheet;

a plurality of transport members disposed between the adjacent abutting portions of the plurality of abutting portions to transport the sheet to a downstream side;

a retracting unit configured to retract the plurality of abutting portions from the sheet transport path; and a controller configured to control the retracting unit to retract the plurality of abutting portions from the sheet transport path when the sheet transported along the sheet transport path has a first size, and to not retract the plurality of abutting portions from the sheet transport path when the sheet transported along the sheet transport path has a second size, the first size being smaller than the second size.

5. A sheet transport device comprising:

a sheet transport path along which a sheet is transported in a first direction;

a plurality of abutting portions on which a leading end of the sheet transported along the sheet transport path abuts, the plurality of abutting portions being arranged in a second direction intersecting the first direction, the second direction extending along a width direction of the sheet;

a sheet container in which the sheet to be supplied to the sheet transport path is stored; and a controller configured to control a motor to change the position of the sheet container, wherein the plurality of abutting portions are distributed in a right-left direction with reference to a predetermined reference extending in the one direction and are arranged in the width direction of the sheet, wherein the sheet is stored in the sheet container so that a center portion of the sheet in the width direction coincides with the predetermined reference, and when the sheet has a predetermined size, the controller is configured to control the motor to change the position of the sheet container such that the sheet is stored at a storage position shifted in the width direction from the predetermined reference so that a preceding corner portion of the sheet abuts on any of the plurality of abutting portions, and wherein the preceding corner portion is defined as a point where two peripheral edges of the sheet intersect.

6. An image forming apparatus comprising:

the sheet transport device according to claim 1, the sheet transport device transporting a sheet; and an image forming unit that forms an image on the sheet transported by the sheet transport device.

7. The sheet transport device according to claim 1, wherein the moving unit is configured to move the plurality of abutting portions in the second direction intersecting the first direction.

8. The sheet transport device according to claim 7, wherein the first and the second directions are perpendicular to a thickness direction of the sheet.

* * * * *